United States Patent [19]

Meyerdierks et al.

[11] 4,026,259

[45] May 31, 1977

[54] FUEL INJECTION DEVICE FOR MIXTURE-CONDENSING, SPARK-IGNITED INTERNAL COMBUSTION ENGINES

[75] Inventors: Dietrich Meyerdierks, Braunschweig; Konrad Barnert, Wolfsburg, both of Germany

[73] Assignee: Volkswagenwerk Aktiengesellschaft, Germany

[22] Filed: Sept. 12, 1975

[21] Appl. No.: 612,714

[30] Foreign Application Priority Data

Sept. 19, 1974 Germany ..... 2244800

[52] U.S. Cl. ..... 123/139 AW; 123/119 R; 261/39 B; 261/50 A

[51] Int. Cl.[2] ..... F02M 1/12; F02M 1/10

[58] Field of Search ..... 123/139 AW, 139 BG, 123/119 R; 261/50 A, 50 AA, 39 A, 39 B

[56] References Cited

UNITED STATES PATENTS

| | | | |
|---|---|---|---|
| 2,523,798 | 9/1950 | Winkler | 261/50 A X |
| 2,583,406 | 1/1952 | Arnold | 261/50 A X |
| 3,613,650 | 10/1971 | Stumpp et al. | 123/139 AW X |
| 3,628,515 | 12/1971 | Knapp et al. | 123/139 AW X |
| 3,835,828 | 9/1974 | Knapp | 123/139 AW X |
| 3,951,120 | 4/1976 | Schlott | 123/139 AW |
| 3,974,809 | 8/1976 | Stumpp et al. | 123/119 R X |

FOREIGN PATENTS OR APPLICATIONS

| | | | |
|---|---|---|---|
| 2,060,254 | 6/1972 | Germany | 123/139 AW |

*Primary Examiner*—C. J. Husar
*Assistant Examiner*—Tony M. Argenbright
*Attorney, Agent, or Firm*—Brumbaugh, Graves, Donohue & Raymond

[57] ABSTRACT

A mixture-condensing, spark-ignited internal combustion engine includes an intake conduit, a fuel injection device for continuously injecting fuel into the intake conduit, and a measuring device located in the intake conduit and capable of being displaced, against a restoring force biasing the measuring device into a rest position, according to the volume of air flowing through the intake conduit. The measuring device regulates a fuel proportioning valve for adjusting the amount of fuel injected into the intake conduit. A stop, adjustable as a function of engine temperature, is engageable with the measuring device to define the rest position thereof.

7 Claims, 1 Drawing Figure

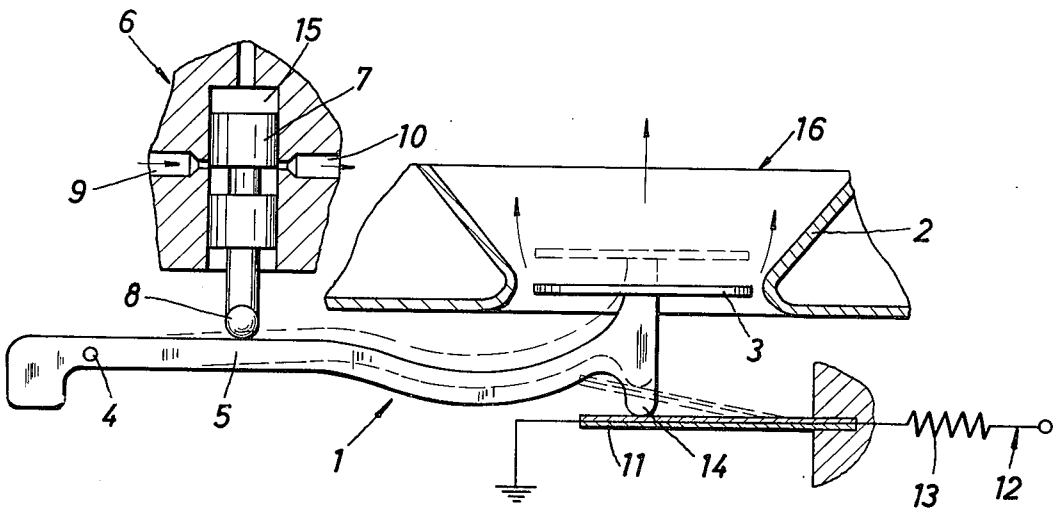
1
2
3
4
5
6
7
8
9
10
11
12
13
14
15
16

FUEL INJECTION DEVICE FOR MIXTURE-CONDENSING, SPARK-IGNITED INTERNAL COMBUSTION ENGINES

BACKGROUND OF THE INVENTION

The present invention relates essentially to a fuel injection device for mixture-condensing, spark-ignited internal combustion engines having means for continuously injecting fuel into an intake conduit of the engine. The intake conduit houses a measuring device capable of being displaced, against a restoring force biasing the measuring device into a rest position, according to the amount of air flowing through the intake conduit. The measuring device, which contacts a stop when in the rest position, also controls a fuel proportioning valve to regulate the amount of fuel injected into the intake conduit.

Such a fuel injection device is described in German Pat. No. 1,960,144. In that device, the restoring force is applied by a pressurized fluid acting at a constant pressure, which is capable of being varied, on a control piston in the fuel proportioning valve, the control piston being shifted by the measuring device. The pressure of the fluid may be varied by a pressure control valve, e.g., as a function of temperature, in order to enrich or increase the fuel content of the fuel-air mixture during the warm-up phase of the engine.

SUMMARY OF THE INVENTION

It is an object of the present invention to provide a fuel injection device for an internal combustion engine which achieves a simplified method of enriching or increasing the fuel content of the fuel-air mixture when the engine is cold.

This object, as well as other objects which become apparent in the discussion that follows, are achieved, according to the present invention, by a stop which is adjustable as a function of engine temperature. Preferably, the stop may comprise a bimetallic leaf spring, which may be associated with an electric heating device for supplying heat to the bimetallic spring in correspondence with the temperature of the engine.

In accordance with one embodiment of the present invention, a fuel injection device is provided with a stop for setting the rest position of a measuring device, which is designed to regulate a fuel proportioning valve according to the temperature prevailing in the engine. Thus, when the engine is cold, the measuring device, including a static disk pivotally mounted in the intake conduit of the engine, regulates the fuel proportioning to permit a greater flow of fuel than when the engine is hot.

According to another embodiment of the invention, the electric heating device may include a resistor having a fixed resistance of such a value that the temperature curve of the bimetallic spring substantially corresponds to that of the engine after a cold start. As a result, when the engine is cold the bimetallic spring and hence the measuring device are shifted comparatively far to a position in which a relatively large amount of fuel is injected into the intake conduit, thereby increasing the fuel content of the fuel-air mixture. On the other hand, when the engine reaches operating temperatures the bimetallic spring and hence the measuring device are shifted to a position in which the amount of fuel injected into the intake conduit is decreased, thereby decreasing the fuel content of the fuel-air mixture.

In order that the deflection of the bimetallic spring is directly dependent on the temperature of the engine, according to yet another embodiment of the present invention, the electric heating device may include a resistor having a resistance which varies with temperature and which is capable of being acted upon by a characteristic temperature of the engine.

DESCRIPTION OF THE DRAWING

For a further understanding of the present invention, reference may be had to the accompanying drawing, in which the single figure is a partial schematical illustration of an embodiment of the present invention.

DESCRIPTION OF THE PREFERRED EMBODIMENTS

Referring to the drawing, a measuring device 1, capable of being displaced according to the volume of air flowing through an intake conduit 16, comprises a static disk 3 positioned in a conical zone 2 of the intake conduit 16. The measuring device 1 also includes a lever 5 pivotally mounted about one end on a pin 4 and attached to the disk 3 at the other end. The lever 5 acts on a plunger 8 attached to the lower end of a control piston 7, which is movably housed in a fuel proportioning valve 6 to control the port area of control lines 9 and 10 leading to injection nozzles (not shown) opening into the intake conduit 16. The upper end of the control piston 7 is acted upon by a fluid pressure prevailing in a pressure chamber 15, thereby biasing the measuring device 1 into a rest position.

Leaf spring 11 acts as a stop for a head 14 of the lever 5. The leaf spring 11 may be a bimetallic element in an electric heating circuit 12. The heating circuit 12 contains a resistor 13, having either a fixed resistance or a resistance varying with temperature and acted upon by a characteristic temperature of the engine.

The solid lines in the drawing indicate the rest position of the measuring device 1 when the engine is warm. The dotted lines, on the other hand, indicate the rest position of the measuring device 1 when the engine is cold. The variance in the displacement of the measuring device 1 in the two rest positions is due to the bimetallic spring 11 which acts as a stop and is substantially straight, as shown by the solid lines, when the engine is warm and curved, as shown by the dotted lines, when the engine is cold. Since piston 7 of the fuel proportioning valve 6 is regulated in accordance with the pivotal movement of the lever 5, when the engine is cold the port area of fuel lines 9 and 10 is increased to admit a larger amount of fuel than when the engine is hot.

When a resistor 13 having a fixed resistance is used in the electric heating circuit 12, the heating of the bimetallic spring 11 may be such that it will occupy the position indicated by the solid lines in the drawing when the engine is warmed up.

Alternatively, a resistor 13 having a resistance varying with temperature, e.g., a so-called NTC resistor, may be utilized. When a temperature variable resistor is used, preferably it should be arranged in a region exhibiting a characteristic temperature of the engine so that the electric heating of the bimetallic spring can be controlled directly as a function of the engine temperature.

In each embodiment, the stop, designed in accordance with the present invention, increases the fuel content of the fuel-air mixture, dependently of the engine temperature, when the measuring device is in the rest position during the idling of the engine.

Besides varying the fuel content of the fuel-air mixture dependently of the engine temperature, the disk 3 of the measuring device 1 is displaced in the conical zone 2 of the intake conduit 16 substantially proportional to the flow of air through the intake conduit 16 in the direction of the arrows. Thus, the fuel proportioning valve 6 and hence the amount of fuel injected into the intake conduit 16 may be adjusted in proportion to the volume of air flowing therethrough.

It will be understood that the described embodiments are merely exemplary and the persons skilled in the art may make many variations and modifications without departing from the spirit and scope of the invention. All such modifications and variations are intended to be included within the scope of the invention as defined in the appended claims.

We claim:

1. In a mixture-condensing, spark-ignited internal combustion engine having an intake conduit, a fuel injection device for continuously injecting fuel into the intake conduit, measuring means located in the intake conduit and capable of being displaced, against a restoring force biasing the measuring means into a rest position assumed only during idling of the engine, according to the volume of air flowing through the intake conduit, and fuel proportioning means, regulated by the measuring means, for regulating the amount of fuel injected into the intake conduit, the improvement comprising stop means temporarily engageable with the measuring means to define the rest position thereof, the stop means being adjustable as a function of engine temperature for regulating the amount of fuel injected into the intake conduit as a function of temperature only during idling of the engine.

2. The fuel injection device of claim 1, wherein the stop means is a bimetallic spring.

3. The fuel injection device of claim 2, wherein the bimetallic spring is associated with an electric heating means for applying heat to the bimetallic spring in correspondence with the temperature curve of the engine.

4. The fuel injection device of claim 3, wherein the electric heating means includes a resistor having a fixed resistance of such a value that the temperature curve of the bimetallic spring substantially matches that of the engine after a cold start.

5. The fuel injection device of claim 3, wherein the electric heating means includes a resistor having a resistance varying with temperature and capable of being acted upon by a characteristic temperature of the engine.

6. The fuel injection device of claim 1, wherein the stop means engages the measuring means in the intake conduit.

7. The fuel injection device of claim 1, wherein the stop means regulates the amount of fuel injected into the intake conduit in such a manner that the amount of fuel varies inversely with respect to engine temperature.

* * * * *

UNITED STATES PATENT AND TRADEMARK OFFICE

CERTIFICATE OF CORRECTION

PATENT NO. : 4,026,259

DATED : May 31, 1977

INVENTOR(S) : Meyerdierks

It is certified that error appears in the above-identified patent and that said Letters Patent are hereby corrected as shown below:

Col. 1, line 52, after "proportioning" insert --valve--;
Col. 2, line 60, "is" should read --has--; and
Col. 4, line 8, after "bimetallic" insert --leaf--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*